US008857397B2

(12) United States Patent
Heyers et al.

(10) Patent No.: US 8,857,397 B2
(45) Date of Patent: Oct. 14, 2014

(54) DEVICE HAVING A FIRST GEARING PART FOR MESHING WITH A SECOND GEARING PART, IN PARTICULAR A STARTING DEVICE HAVING A PINION FOR MESHING WITH A RING GEAR OF AN INTERNAL COMBUSTION ENGINE, AND A METHOD FOR OPERATING A DEVICE

(75) Inventors: Klaus Heyers, Reutlingen (DE); Jie Ge, Stuttgart-Hausen (DE); Apostolos Tsakiris, Ludwigsburg (DE); Jochen Heusel, Reutlingen (DE); Martin Neuburger, Geislingen (DE)

(73) Assignee: Robert Bosch GmbH, Stuttgart (DE)

( * ) Notice: Subject to any disclaimer, the term of this patent is extended or adjusted under 35 U.S.C. 154(b) by 1271 days.

(21) Appl. No.: 12/281,895

(22) PCT Filed: Feb. 9, 2007

(86) PCT No.: PCT/EP2007/051281

§ 371 (c)(1),
(2), (4) Date: May 13, 2010

(87) PCT Pub. No.: WO2007/101770

PCT Pub. Date: Sep. 13, 2007

(65) Prior Publication Data

US 2010/0282199 A1 Nov. 11, 2010

(30) Foreign Application Priority Data

Mar. 6, 2006 (DE) ..... 10 2006 011 644

(51) Int. Cl.
*F02N 11/08* (2006.01)
*F02N 15/06* (2006.01)

(52) U.S. Cl.
CPC ..... *F02N 11/0855* (2013.01); *F02N 2200/022* (2013.01); *F02N 15/067* (2013.01); *F02N 11/0814* (2013.01); *F02N 2200/041* (2013.01); *F02N 2300/102* (2013.01)
USPC ..... 123/179.3; 701/113

(58) Field of Classification Search
USPC ..... 123/19.1, 179.3, 179.22, 179.25; 701/113; 310/83, 87; 290/38 B, 38 C, 290/38 E, 38 R
See application file for complete search history.

(56) References Cited

U.S. PATENT DOCUMENTS 4,495,905 A * 1/1985 Morishita et al. ..... 123/179.31
4,875,643 A * 10/1989 Gietzen et al. ..... 244/53 A (Continued)

FOREIGN PATENT DOCUMENTS

| | | |
|---|---|---|
| DE | 43 31 226 | 3/1995 |
| DE | 197 02 932 | 7/1998 |
| DE | 694 17 321 | 11/1999 |
| DE | 100 05 005 | 10/2000 |
| DE | 102 25 249 | 12/2003 |
| DE | 10 2005 004 326 | 2/2006 |
| GB | 2 241 756 | 9/1991 |
| JP | 62-85172 | 4/1987 |
| JP | 6-264995 | 9/1994 |
| JP | 2003-3938 | 1/2003 |
| JP | 2003-139029 | 5/2003 |
| JP | 2004-44393 | 2/2004 |
| JP | 2005-330813 | 12/2005 |
| WO | WO 95/08056 | 3/1995 |
| WO | WO 98/40647 | 9/1998 |
| WO | WO 2006/016350 | 2/2006 |

*Primary Examiner* — John Kwon
*Assistant Examiner* — Johnny H Hoang
(74) *Attorney, Agent, or Firm* — Kenyon & Kenyon LLP

(57) ABSTRACT

A device having a first gearing part for meshing with a second gearing part, in particular a starter device having a pinion for meshing with a ring gear of an internal combustion engine, in which at least one arrangement is provided whereby a motion state of the first gearing part and a motion state of the second gearing part are ascertainable. A method for operating a device having a first gearing part for meshing with a second gearing part, in particular a starter device having a pinion for meshing with a ring gear of an internal combustion engine, in which at least one arrangement is provided whereby a motion state of the first gearing part and a motion state of the first gearing part and a motion state of the second gearing part are ascertained.

30 Claims, 3 Drawing Sheets

(56) References Cited

U.S. PATENT DOCUMENTS

| | | | | |
|---|---|---|---|---|
| 5,127,279 | A * | 7/1992 | Barthruff | 74/6 |
| 5,402,758 | A * | 4/1995 | Land et al. | 123/179.3 |
| 5,877,575 | A * | 3/1999 | Nara et al. | 310/239 |
| 6,453,879 | B2 * | 9/2002 | Joos et al. | 123/497 |
| 6,763,735 | B2 * | 7/2004 | Siems et al. | 74/6 |
| 7,472,672 | B2 * | 1/2009 | Asada et al. | 123/179.25 |
| 2001/0011537 | A1 * | 8/2001 | Joos et al. | 123/497 |
| 2008/0127927 | A1 | 6/2008 | Hirning et al. | |
| 2008/0258472 | A1 * | 10/2008 | Mottier | 290/38 D |

* cited by examiner

DEVICE HAVING A FIRST GEARING PART FOR MESHING WITH A SECOND GEARING PART, IN PARTICULAR A STARTING DEVICE HAVING A PINION FOR MESHING WITH A RING GEAR OF AN INTERNAL COMBUSTION ENGINE, AND A METHOD FOR OPERATING A DEVICE

FIELD OF THE INVENTION

The present invention relates to a device having a first gearing part for meshing with a second gearing part, including a starter device having a pinion for meshing with a ring gear of an internal combustion engine.

BACKGROUND INFORMATION

A starter device having a pinion for meshing with a ring gear of an internal combustion engine is discussed in unexamined patent application DE 197 02 932 A1. The starter device discussed therein is suitable, in particular, for being operated in so-called start/stop mode. This means that the number of starts which this starter device is technically capable of is increased to five to ten times a customary value for a starter device. This is made possible by operating the so-called latching relay of this starter device timed in a special manner. This special timing of this latching relay makes it possible to accelerate the pinion at a slower rate prior to meshing with the ring gear and thereby reduce the impact forces of the pinion or the forces between the pinion and the ring gear, compared to a customary starter device. This greatly reduces the wear associated with use and increases the service life.

If a starter device of this type is operated in the so-called start/stop mode of the vehicle, situations arise in which meshing of the pinion and cranking of the internal combustion engine must take place relatively rapidly. This is the case, in particular, when, for example, a vehicle comes to a standstill at a traffic light set to "Stop," yet, for example, the internal combustion engine is clearly and unequivocally to be set into operation even while the internal combustion engine is still coasting, for example because the light has switched to "Go." In such a case, it is necessary to wait for the internal combustion engine to come to a standstill so that the pinion of the starter device may be meshed with the ring gear. In an operating mode of this type, it is therefore not possible to rule out a loss of safety and comfort with regard to immediate resumption of travel.

SUMMARY OF THE INVENTION

Advantages

The device according to the present invention, having the features of the main claim, has the advantage that the at least one means may be used to ascertain a motion state of the first gearing part (pinion) and a motion state of the second gearing part (ring gear) and thereby ascertain an overall state which enables the first gearing part to mesh with the second gearing part while both gearing parts are rotating. This resulting capability makes it possible to remesh a first gearing part even before an internal combustion engine, and thus the second gearing part, has come to a stop. As a result, a vehicle in start/stop mode may begin moving again earlier than in the case of previous approaches. The vehicle may be operated more comfortably, and any safety-critical phases in which the vehicle is unable to be maneuvered are avoidable.

To ascertain the suitable motion state of both the first and the second gearing parts, it is provided that the means include, for example, a control unit in which various variables are evaluated. A control unit of this type makes it possible to ascertain the suitable motion state particularly quickly and ultimately to also decide particularly quickly when the first gearing part is to engage with the second gearing part.

If a rotational speed sensor for ascertaining a rotational speed of the second gearing part is provided, it is possible to ascertain a particularly accurate resolution and therefore make a particularly accurate determination of the rotational speed of the second gearing part. A particularly gentle engagement of both gearing parts may therefore take place. A further improvement is achieved if separate rotational speed sensors are available for the first and the second gearing parts.

It is particularly advantageous if, on the one hand, the device having the first gearing part includes a drive motor which enables a rotary motion to be imparted to the first gearing part and, on the other hand, the device includes an actuator, in particular an electric solenoid which enables the first gearing to be moved, in particular to be moved axially, and to do this independently of a rotary motion or an activation of the drive motor. This avoid forced situations which result in unsuitable motion states.

To produce a particularly compact device, it is provided that a bearing flange, which is frequently referred to as a so-called drive bearing, is used both as a fastener for the toe-in actuator and for the control unit.

It is also provided that a characteristics map, in which at least one characteristic of the device is assigned to at least one other characteristic, is stored in the control unit. A characteristic may be, for example, an electric voltage level from which a rotational speed and thus also an angular velocity are derived, the latter being the other characteristic. This has the advantage that information indicating the angular velocity of the first gearing part may be quickly obtained without arithmetic operations.

Alternatively, the characteristics may also be mapped by a physical model. For example, the model may be mapped by the equation $n_{23}=C*U_{45}$. In this model, rotational speed $n_{23}$ of the second gearing part is ascertained from the measurement of generator voltage $U_{45}$ of the drive. In this case, C is a constant to be determined.

Exemplary embodiments of a device according to the present invention as well as a method for operating a device of this type are illustrated in the drawings.

DETAILED DESCRIPTION

Figure 1:
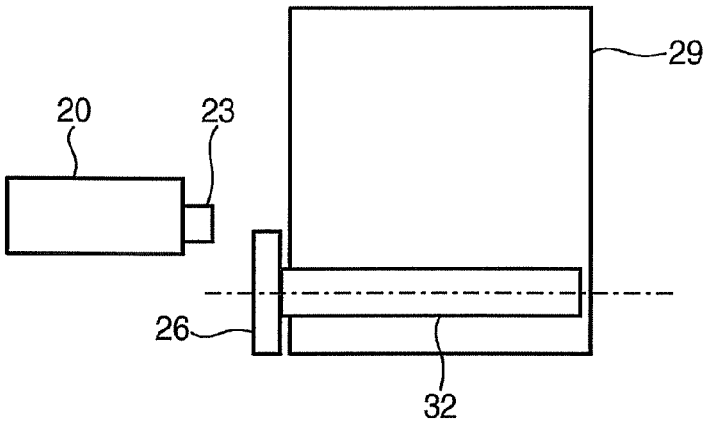
FIG. 1 shows a symbolic representation of a device having a first gearing part for meshing with a second gearing part, in particular a starter device having a pinion for meshing with a ring gear of an internal combustion engine.

FIG. 1 shows a device 20 having a first gearing part 23, which is provided for meshing with a second gearing part 26.

Device 20 is provided, in particular, as a starter device, so that first gearing part 23 is customarily designed as a pinion. It does not matter whether the starter is a so-called open-mouth starter, in which radial forces are supported by bearings axially on both sides of gearing part 23, or whether it is a so-called freely disengaging starter, in which axial forces are supported on only one side of gearing part 23. Second gearing part 26, usually a ring gear, in this case is part of an internal combustion engine 29, which is also illustrated only symbolically, just like starter device 20. This internal combustion engine 29 supports an engine shaft 32, to which second gearing part 26 is at least indirectly attached and thus is able to rotate together with engine shaft 32. In contrast to previously known devices 20, whose first gearing part 23 is usually able to engage only with stationary second gearing parts 26, it is provided within the framework of the description to demonstrate how a device 20 according to the present invention is able to mesh its first gearing part 23 with a moving, that is rotating, second gearing part 26.

Figure 2:
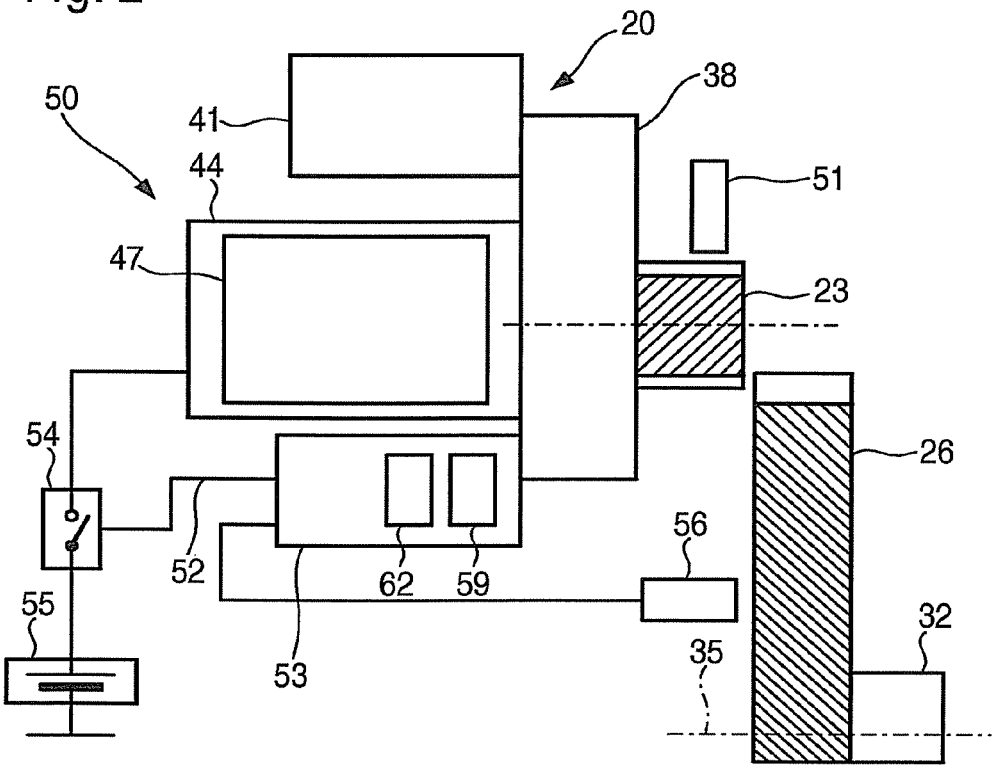
FIG. 2 shows a side view of a device having a first gearing part prior to meshing with a second gearing part.

FIG. 2 shows an enlarged representation of a section of internal combustion engine 29, or as a projection thereof, engine shaft 32, second gearing part 26 and the rotation axis of second gearing part 26, which is identified here by reference numeral 35. Device 20, which in this case is designed as a so-called freely disengaging starter, is shown on the left side of FIG. 2. It should be noted at this point that it is equally possible to design this device 20 as a so-called open-mouth starter; the design does not impair the function of the invention described herein. In this case, this device 20 shows first gearing part 23 in the so-called non-meshed state, that is, in the idle state of device 20. A bearing flange 38, which represents a load-carrying element of device 20, is shown after first gearing part 23. Bearing flange 38 is often also referred to as a so-called drive bearing. An actuator 41, which performs a specified function with regard to an axial movement of first gearing part 23, is attached at the back and top of this bearing flange 38. A housing 44, which is, for example, a so-called pole housing, is shown below actuator 41. A rotor 47, which interacts with housing 44 or pole housing 44 to form a drive motor 50, is situated within pole housing or housing 44. A control unit 53, which is also attached to bearing flange 38, is shown below drive motor 50.

The control unit may also be designed as a removable device. However, the design of the mounted control unit illustrated here is more advantageous, since this enables the manufacturer of device 20 to manufacture, deliver and mount a compact unit without having to enable other non-secure connection processes to take place in the vehicle plant. In addition, this unit may be tested complete in the plant of the manufacturer of device 20 without having to subsequently disassemble it again. A rotational speed sensor 56 is also shown to the right of second gearing part 26. Rotational speed sensor 56 has the function of ascertaining the rotational speed of second gearing part 26 or of acting as an aid thereto. Actuator 41 is used to move first gearing part 23 from its idle position in the axial direction during the operating state and to thereby mesh the first gearing part with second gearing part 26. As in the case of common starter systems, drive motor 50 is used to cause first gearing part 23 to rotate and to apply a torque to second gearing part 26. A second rotational speed sensor 51 for ascertaining rotational speed $n_{23}$ is optional, while a required data line between sensor 51 and control unit 53 is not illustrated. Control unit 53 switches a switch 54 via a control line 52, enabling current to be supplied to device 20 to via battery 55.

Figure 3:
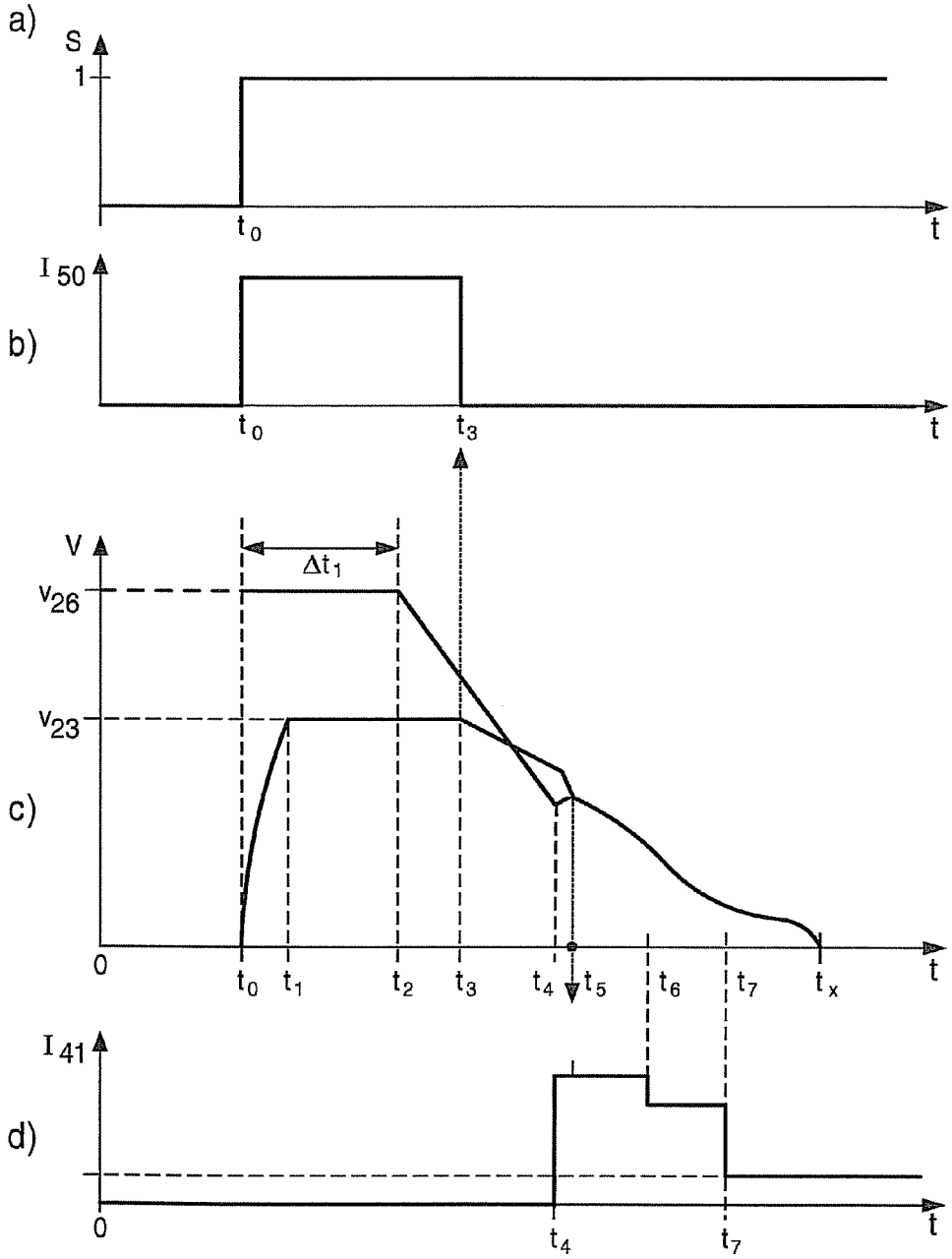
FIG. 3 shows a diagram with regard to the curve of the peripheral velocities of the first and second gearing parts over the course of time and also, associated therewith, the curve of three different signals.

The functions of the device and its fundamental mode of operation are illustrated below:

It is assumed, for example, that internal combustion engine 29 is initially in the activated state, that is, engine shaft 32, designed for example as a crankshaft, is rotating. This applies, for example, to a vehicle being driven on a road. If the vehicle then stops at a traffic light, for example, internal combustion engine 29 in a vehicle having the so-called start/stop system provided is shut down in the presence of certain conditions, for example an open drivetrain (interruption in the transmission of torque from internal combustion engine 29 to a gearbox by opening a clutch), or in the case of a minimum vehicle velocity v<7 km/h or a battery charge state<70%. Of course, two or all three conditions may also be met at the same time. To prevent loss of comfort and safety during this so-called start/stop mode, it is provided that the internal combustion engine may be restarted very quickly. For this purpose, it is provided that first gearing part 23 is meshed very early with second gearing part 26. In this case, this means that first gearing part 23 is meshed with second gearing part 26 as early as the so-called coasting phase of internal combustion engine 29; also see FIG. 3.

FIGS. 3*a* through 3*d*, in principle, show related curves in connection with the meshing of a first gearing part 23 with a second gearing part 26. If the start/stop system provided on board the vehicle decides that the internal combustion engine should be shut down, signal S, which is used for transmitting the signal for meshing first gearing part 23 with second gearing part 26, is set to "1" (FIG. 3*a*). As a result of this activation signal at point in time $t_0$, drive motor 50 of device 20 is activated so that a current $I_{50}$ flows through drive motor 50 and thereby imparts a rotary motion to rotor 47. At the same time, a rotary motion is imparted to first gearing part 23 (FIG. 3*c*). The representation of the curve of the current in FIG. 3*b* is idealized.

This activation signal (FIG. 3*a*) first imparts a rotary motion to gearing part 23. After a certain time $t_1$, which is not determined more precisely, this first gearing part reaches a maximum peripheral velocity $v_{23}$ of first gearing part 23, which is illustrated in an idealized manner in FIG. 3*c*.

At the start of point in time $t_0$, a time $\Delta t_1$ begins running in control unit 53. Upon expiry of this time $\Delta t_1$ at point in time $t_2$, internal combustion engine 29 is actually shut down; that is, its rotational speed $n_{26}$ or peripheral velocity $v_{26}$ at second gearing part 26 begins to slow down (also see FIG. 3*c*). In the exemplary embodiment, the ascertainment of the rotational speeds of second gearing part 26 and first gearing part 23 which are relevant for the meshing operation of first gearing part 23 with second gearing part 26 to be carried out begins at this point in time. Of course, the rotational speed ascertainment may also begin, for example, at point in time $t_0$. In the exemplary embodiment, it is provided that the rotational speed of second gearing part 26 is ascertained with the aid of rotational speed sensor 56. The rotational speed with regard to first gearing part 23 is ascertained at the start of point in time $t_3$ after second gearing part 26 has reached a preset rotational speed threshold. At this point in time $t_3$, drive motor 50 is shut down (also see FIG. 3*b*).

As is generally known, a drive motor 50 which is no longer being driven, i.e., in this case one which is no longer being supplied with power, generates an output voltage $U_{45}$ (in proportion to rotational speed $n_{23}$) at one of its terminals, which in this case is designed "terminal 45" according to known standards (DIN 72552), this voltage being produced by the now generator operation of device 20. By comparison with comparison values stored in a characteristics map 59, an essentially determined rotational speed and therefore peripheral velocity $v_{23}$ of first gearing part 23 may be derived from the voltage level of this voltage $U_{45}$. By further continuously monitoring the system over the course of time and thereby detecting a suitable motion state of first gearing part 23 and second gearing part 26, the system—represented by control unit 53—finally infers a suitable motion state (i.e., peripheral velocities $v_{26}$ and $v_{23}$ differ only slightly from each other and enable meshing to take place) and controls actuator 41 at point in time $t_4$ in such a way that this actuator is supplied with current ($I_{41}$) and thus moves first gearing part 23 in the direction of second gearing part 26. The curves in FIG. 3*c*) and FIG. 3*d*) are slightly idealized in this respect. The axial motion of the pinion or first gearing part 23 takes place in an actually delayed manner. Since a suitable motion state is present with regard to first gearing part 23 and second gearing part 26 (the peripheral velocities of both gearing parts are essentially identical), first gearing part 23 meshes with second gearing part 26 without difficulty and without any appreciable resistance. Since, in the embodiment described here, peripheral velocity $v_{23}$ of first gearing part 23 is only insubstantially higher at point in time $t_4$ than that of second gearing part 26, the two peripheral velocities $v_{23}$ and $v_{26}$ converge up to point in time $t_5$, that is, up to the form-locking engagement of both gearing parts described herein by way of example, so that the two peripheral velocities $v_{23}$ and $v_{26}$ are equal at point in time $t_5$. From this point in time $t_5$ onward, the two gearing parts 23 and 26 mesh with each other up to point in time $t_x$ and beyond. After point in time $t_5$, the current of actuator 41 is reduced at point in time $t_6$ and finally, after a further time has elapsed, the current is switched back to a lower level at point in time $t_7$.

Current $I_{41}$ is varied for the following reason: The goal is to achieve a noise-optimized meshing, i.e., the actuator should not absorb any excess energy, if possible. Since the magnetic circuit has a large air gap and therefore a high magnetic resistance at the beginning of the meshing process, the magnetomotive force and thus current $I_{41}$ must also be high. The magnetic energy is, in part, converted into spring energy, but also to kinetic energy. This reduces the air gap in the solenoid. To then prevent the solenoid armature from accelerating too much, the current is reduced in the second phase between $t_6$ and $t_7$. If the pinion is now completely meshed, the magnetomotive force may be reduced, since the pinion prevents disengagement with gearing part 26 by the automatic interlocking of the steep-lead-angle thread between rotor 47 and pinion 23. Starting at point in time $t_7$, the current may therefore, in principle, be reduced to zero amperes.

For the purpose of effective adaptation to the environmental conditions, the current-path characteristic curve is stored in the control unit as a function of the temperature and additional environmental variables.

The two gearing parts 23 and 26 ultimately come to a stop at point in time $t_x$ and therefore no longer continue rotating. In this exemplary embodiment, a further start operation of internal combustion engine 29 may therefore take place after point in time $t_x$. This takes place, or would take place, after this point in time by supplying a driving current $I_{50}$ to drive motor 50, so that first gearing part 23 transmits a positive driving torque to second gearing part 26. However, a further start operation of internal combustion engine 29 may also take place prior to this point, provided that the two gearing parts 23 and 26 engage with each other to an adequate depth.

Within the framework of this exemplary embodiment, therefore, a method for operating a device 20 having a first gearing part 23 is described, first gearing part 23 being provided for meshing with a second gearing part 26. Device 20 is designed, in particular, as a starter device and has a pinion as a possible embodiment of first gearing part 23, which is provided for meshing with a ring gear (second gearing part 26) of an internal combustion engine 29. According to the method described herein, at least one arrangement (rotational speed sensor 56, terminal 45, control unit 53, characteristic 59) is provided whereby a motion state (rotational speed or peripheral velocity) of first gearing part 23 and a motion state (rotational speed or peripheral velocity) of second gearing part 26 is ascertained.

It is provided that the at least one arrangement (rotational speed 56, terminal 45, control unit 53, characteristics map 59) is used to ascertain rotational speed $n_{26}$ of second gearing part 26 as the characteristic of the motion state of second gearing part 26 and rotational speed $n_{23}$ of first gearing part 23 as the characteristic of the motion state of first gearing part 23.

Within the framework of the method described herein, it is provided that the at least one arrangement (56, 45, 53, 59) is used to ascertain, from rotational speed $n_{26}$ of second gearing part 26 and rotational speed $n_{23}$ of first gearing part 23, a suitable motion state which enables first gearing part 23 to mesh with second gearing part 26. The expression "suitable motion state" means that first gearing part 23 is able to mesh with second gearing part 26 without appreciable resistance during the meshing of the two rotating gearing parts. The meshing operation or the suitable motion state makes it possible for the two gearing parts 23 and 26 to engage in a non-destructive manner while they are rotating.

As described above, it is provided that, for the purpose of engaging first gearing part 23 with second gearing part 26, a peripheral velocity $v_{23}$ other than zero of first gearing part 23 is brought into proximity with a peripheral velocity $v_{26}$ other than zero of second gearing part 26 in one method step. In a further method step, first gearing part 23 is subsequently engaged with second gearing part 26 ($t_4$ to $t_5$).

It is provided that, for the purpose of achieving proximity between peripheral velocities $v_{23}$ and $v_{26}$ of first gearing part 23 and second gearing part 26, on the one hand internal combustion engine 29 is shut down ($t_2$), thereby reducing peripheral velocity $v_{26}$ of second gearing part 26 (starting at $t_2$) and, on the other hand, the peripheral velocity of first gearing part 23 is increased (starting at point in time $t_0$).

According to this first exemplary embodiment, regarding the sequence in which internal combustion engine 29 is shut down and drive motor 50 is activated, drive motor 50 may be activated first, and internal combustion engine 29 is shut down only thereafter.

As explained above, it is provided that first gearing part 23 is meshed with second gearing part 26 after peripheral velocities $V_{23}$ and $V_{26}$ of first gearing part 23 and second gearing part 26 have achieved a sufficient proximity. Peripheral velocities $V_{23}$ and $V_{26}$ are other than zero in this case.

According to a further method step, it is provided that, following a suitable starting signal (for example, depressing the gas pedal of the motor vehicle) a positive driving torque $M_n$ is transmitted by first gearing part 23 to second gearing part 26 and thus to engine shaft 32 after first gearing part 23 meshes with second gearing part 26.

As explained according to this first exemplary embodiment, it is provided that, prior to transmitting positive driving torque $M_{23}$, first gearing part 23 and second gearing part 26 together, and in the meshed state of both gearing parts, achieve a state in which the peripheral velocities of both gearing parts are zero ($t_x$). However, a driving torque $M_{23}$ may also be transmitted at an earlier point (after $t_5$), the gearing parts in this case not achieving a peripheral velocity of zero.

In monitoring the system of device 20 and internal combustion engine 29, it is provided that rotational speeds $n_{23}$ and $n_{26}$ of the gearing parts are ascertained, in particular, after point in time $t_2$, for the purpose of ascertaining a suitable motion state of second gearing part 26 and first gearing part 23.

Since the rotational speeds of the two gearing parts 23 and 26 do not yet enable a statement to be made per se about a suitable motion state—both gearing parts 23 and 26 usually have substantial differences in their diameters in the range of a factor of 10—a peripheral velocity $v_{23}$ or $v_{26}$ must be ascertained from the rotational speeds of the two gearing parts for the purpose of ultimately ascertaining an adequate equality between the two peripheral velocities.

Alternatively, it is not absolutely necessary to ascertain peripheral velocities $v_{23}$ and $v_{26}$. It is equally possible to store suitable rotational speeds of the two gearing parts 23 and 26, for example in a characteristics map 62 of control unit 53. For example, for a factor of 10 with regard to the difference in the diameters of the two gearing parts, this means specifically that a rotational speed of 300 revolutions per minute is suitable for meshing a first gearing part 23 with a second gearing part 26 if the latter has a rotational speed of 30 revolutions per minute. Such rotational speeds of the two gearing parts, which would enable a meshing to take place, are referred to herein as equivalents.

Figure 4:
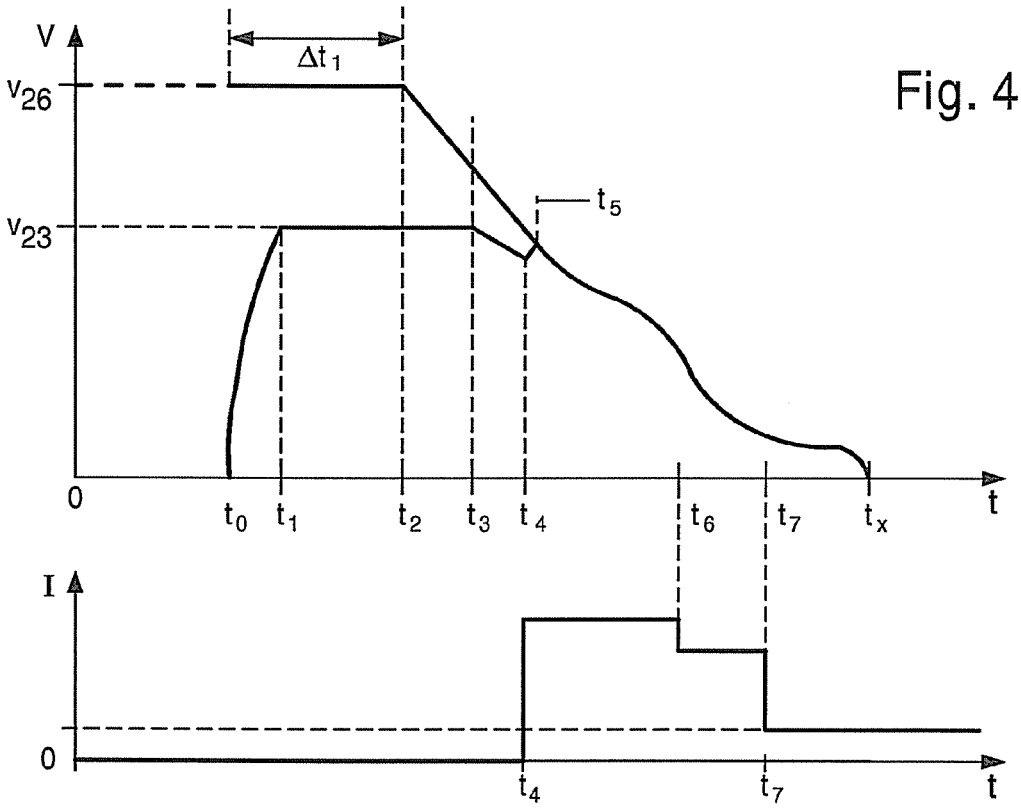
FIG. 4 shows a further diagram with regard to the curve of the peripheral velocities of the first and second gearing parts over a slightly different course of time.

FIG. 4 shows a slightly modified variant compared to the meshing operation illustrated in FIG. 3*c*. The main difference here is that, while first gearing part 23 still meshes with second gearing part 26 at point in time $t_4$, in this case, as is clearly apparent, velocity $v_{26}$ is greater than velocity $v_{23}$. In contrast to FIG. 3*c*, when first gearing part 23 meshes with second gearing part 26, the latter must therefore be slightly accelerated to ultimately complete the meshing process at point in time $t_5$. Ensuring rapid engagement may be established by a number of different measures: For example, a current pulse of short duration after $t_4$ may be sufficient to achieve a rotational speed $n_{23}$ or peripheral velocity $v_{23}$ which is not checked to any further extent, yet is suitable. If rotational speed $n_{23}$ or peripheral velocity $v_{23}$ is too high following the current pulse, rotational speed $n_{23}$ or peripheral velocity $v_{23}$ may be achieved either by evaluating generatively ascertained (generated) voltage $U_{45}$ or by monitoring the rotational speed via sensor 51.

With regard to the previously described way in which the starter rotational speed or the rotational speed of drive motor 50 is ascertained, the rotational speed is ascertainable not only from the generator voltage present at terminal 45, but it may also be ascertained beyond this as a function of the operating temperature of device 20 or its time of operation. In a further embodiment, such a dependency of rotational speed $n_{23}$ may also be stored in a characteristics map in control unit 53 (or in a different control unit).

The starter rotational speed may also be ascertained using an additional sensor 51 at pinion 23. Magnetic sensors which detect the modulation of a magnetic field by the iron teeth of the ring gear may be suitable for this purpose.

If rotational speed $n_{23}$ of drive motor 50 is to be ascertained in the energized state of drive motor 50, this may be carried out, for example, using a characteristic or a characteristics map, it being possible to take into account the temperature of device 20 and its supply voltage at terminal 45. The starter current or driving current $I_{45}$ is measured in control unit 53 for this purpose.

With regard to the sequence in which internal combustion engine 29 is shut down and drive motor 50 is activated, a sequence other than the one described according to the first exemplary embodiment or the second exemplary embodiment may be selected: For example, internal combustion engine 29 may be first shut down and the starter motor or drive motor 50 subsequently activated. Likewise, it is also possible to simultaneously shut down internal combustion engine 29 and activate drive motor 50. With regard to the illustrations in FIGS. 3*c* and 4, the curves shift to the left or to an earlier point with regard to the shift of point in time $t_2$ to point in time $t_0$. Accordingly, point in time $t_3$ and subsequent points in time in such a case would also be shifted to an earlier point in time, that is, in the direction of point in time $t_0$.

Figure 5:
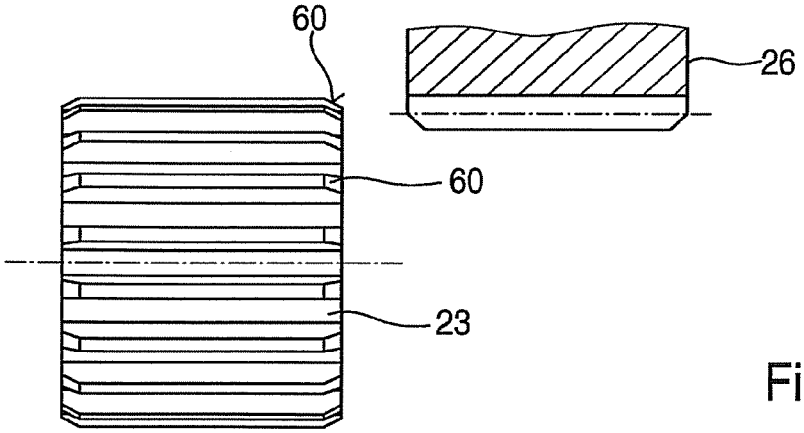
FIG. 5 shows a first and a second gearing part.

FIG. 5 shows a meshing for first gearing part 23, individual teeth on the end of gearing part 23 facing second gearing part 26, each having a bevel 60 which facilitates meshing of first gearing part 23 with second gearing part 26.

The rotational speed of engine shaft 32 may also be supplied to control unit 53, for example via a data system provided in the motor vehicle, for example via the so-called CAN-bus.

In the system described herein, it is provided that the internal combustion engine coasts when the throttle valve is closed to prevent the internal combustion engine from shaking during coasting, which is generally perceived as bothersome. This also prevents the engine from swinging back, which would result in a loud coasting noise during engagement of gearing part 23. Device 20 remains in the meshed state via its first gearing part until the internal combustion engine is set into rotation again.

Characteristics maps 59 and 62 may also be designed as a common characteristics map (table).

What is claimed is:

1. A system, comprising:

a starter device having a first gearing part, the first gearing part being a pinion;

an internal combustion engine having a second gearing part, the second gearing part being a ring gear, wherein the pinion meshes with the ring gear; and at least one arrangement to determine a motion state of the pinion and a motion state of the ring gear, so as to ascertain an overall state which enables the first gearing part to mesh with the second gearing part while both gearing parts are rotating, wherein the first gearing part is remeshable even before the second gearing part has come to a stop.

2. The system of claim 1, wherein the at least one arrangement is also for determining the rotational speed of the ring gear as a characteristic of the motion state thereof, and for determining the rotational speed of the pinion as a characteristic of the motion state thereof.

3. The system of claim 2, wherein the at least one arrangement is also for determining, from the rotational speed of the ring gear and the rotational speed of the pinion, a motion state which enables or does not enable an engagement of the first pinion with the ring gear.

4. The system of claim 1, wherein the arrangement includes a control unit.

5. The system of claim 1, further comprising:

a rotational speed sensor for determining a rotational speed of the ring gear.

6. The system of claim 1, wherein the device includes a drive motor which can impart a rotary motion to the pinion.

7. The system of claim 1, wherein the device includes an actuator, which is an electric solenoid, whereby the pinion can be moved in an axial direction.

8. The system of claim 1, wherein a toe-in and a rotary motion of the pinion are independently controllable.

9. The system of claim 1, wherein the pinion has a toothed structure, individual teeth on the end of the pinion facing the ring gear, each having at least one bevel which facilitates meshing of the pinion with the second gearing part.

10. The system of claim 1, wherein the starter device has a bearing flange to which both the actuator and the control unit are attached.

11. The system of claim 1, wherein a characteristics map, in which at least one characteristic of the system is assigned to at least one other characteristic, is stored in a control unit.

12. The system of claim 11, wherein a rotational speed of the pinion is assigned to a characteristic of the electric flux through the drive motor, the characteristic being a voltage.

13. The system of claim 12, wherein a voltage which is present across a conductor connected to the drive motor in generator mode of the drive motor is ascertainable by the control unit.

14. The system of claim 1, further comprising:

a comparing arrangement to compare the determined motion state of the pinion and the determined motion state of the ring gear, where the first gearing part is remeshed before the second gearing part has come to a stop.

15. The system of claim 1, further comprising:

an actuator to move the first gearing part in a direction of the second gearing part until they mesh, wherein a current in the actuator is varied so as to achieve a noise-optimized meshing by preventing a solenoid armature of the actuator from accelerating too much.

16. A method for operating a system of a starter device and an internal combustion engine, the method comprising:

determining a motion state of a pinion using at least one arrangement; and determining a motion state of the ring gear using the at least one arrangement, wherein the starter device has a first gearing part and the internal combustion engine has a second gearing part, the first gearing part being the pinion and the second gearing part being the ring gear, and wherein the pinion is meshed with the ring gear, wherein an overall state is ascertained which enables the first gearing part to mesh with the second gearing part while both gearing parts are rotating, and wherein the first gearing part is remeshable even before the second gearing part has come to a stop.

17. The method of claim 16, wherein the at least one arrangement is used for ascertaining a rotational speed of the ring gear as a characteristic of the motion state thereof, and for ascertaining a rotational speed of the pinion as a characteristic of the motion state thereof.

18. The method of claim 17, wherein the at least one arrangement is used for ascertaining, from the rotational speed of the ring gear and the rotational speed of the pinion, a suitable motion state which enables or does not enable an engagement of the pinion with the ring gear.

19. The method of claim 16, wherein to engage the first gearing part with the ring gear, a peripheral velocity other than zero of the first gearing part is brought into proximity with a peripheral velocity other than zero of the ring gear, and wherein the first gearing part is subsequently brought into engagement with the ring gear.

20. The method of claim 19, wherein to achieve proximity between peripheral velocities of the pinion and the ring gear, the internal combustion engine is shut down and the peripheral velocity of the ring gear is thereby reduced, and the peripheral velocity of the pinion is increased.

21. The method of claim 16, wherein with regard to a sequence in which the internal combustion engine is shut down and the drive motor is started up, one of the following options is selected:

a) first activate the drive motor, then shut down the internal combustion engine;

b) first shut down the internal combustion engine, then start up the drive motor;

c) simultaneously shut down the internal combustion engine and activate the drive motor.

22. The method of claim 16, wherein the pinion is meshed with the ring gear after the peripheral velocities and of the pinion and the ring gear have achieved a sufficient proximity.

23. The method of claim 22, wherein the peripheral velocities are other than zero.

24. The method of claim 22, wherein a positive driving torque is transmitted to the ring gear by the pinion after the pinion has meshed with the ring gear.

25. The method of claim 24, wherein the pinion and the ring gear together achieve a peripheral velocity of zero in the meshed state before the positive driving torque is transmitted.

26. The method of claim 16, wherein rotational speeds of the pinion and the ring gear are ascertained at specified points in time for the purpose of ascertaining a suitable motion state of the ring gear and the pinion.

27. The method of claim 26, wherein peripheral velocities of the pinion and ring gear are ascertained from the rotational speeds, and the rotational speeds of the pinion and the ring gear are compared with one another.

28. The method of claim 27, wherein the rotational speeds of the pinion and the ring gear are compared with values which are stored in a characteristics map of a control unit, suitable rotational speeds for meshing the pinion with the ring gear being assigned to one another in the characteristics map.

29. The method of claim 16, further comprising:

comparing the determined motion state of the pinion and the determined motion state of the ring gear, where the first gearing part is remeshed before the second gearing part has come to a stop.

30. The method of claim 16, further comprising:

varying a current in an actuator so as to achieve a noise-optimized meshing by preventing a solenoid armature of the actuator from accelerating too much, wherein the actuator is operable to move the first gearing part in a direction of the second gearing part until they mesh.

* * * * *